US009162139B2

(12) United States Patent
Lando

(10) Patent No.: US 9,162,139 B2
(45) Date of Patent: Oct. 20, 2015

(54) CUBE PUZZLE

(76) Inventor: Mordechai Lando, Beer-Sheva (IL)

( * ) Notice: Subject to any disclaimer, the term of this patent is extended or adjusted under 35 U.S.C. 154(b) by 254 days.

(21) Appl. No.: 13/516,734

(22) PCT Filed: Jan. 20, 2011

(86) PCT No.: PCT/IL2011/000062

§ 371 (c)(1),
(2), (4) Date: Aug. 23, 2012

(87) PCT Pub. No.: WO2011/092682

PCT Pub. Date: Aug. 4, 2011

(65) Prior Publication Data

US 2012/0306153 A1 Dec. 6, 2012

Related U.S. Application Data

(60) Provisional application No. 61/300,046, filed on Feb. 1, 2010.

(51) Int. Cl.

| | |
|---|---|
| ***A63F 9/10*** | (2006.01) |
| ***A63F 9/12*** | (2006.01) |
| ***A63F 7/06*** | (2006.01) |
| *A63F 9/24* | (2006.01) |

(52) U.S. Cl.

CPC ..... *A63F 9/10* (2013.01); *A63F 7/0664* (2013.01); *A63F 9/12* (2013.01); *A63F 2009/1072* (2013.01); *A63F 2009/1296* (2013.01); *A63F 2009/241* (2013.01); *A63F 2009/2402* (2013.01); *A63F 2009/2457* (2013.01); *A63F 2009/2485* (2013.01)

(58) Field of Classification Search

CPC ..... A63F 9/10; A63F 9/12; A63F 9/1204; A63F 9/1288; A63F 2009/0698

USPC ..... 273/156, 157 R, 160

See application file for complete search history.

(56) References Cited

U.S. PATENT DOCUMENTS

| | | | | | |
|---|---|---|---|---|---|
| 907,203 | A | * | 12/1908 | Walker | 273/157 R |
| 3,637,217 | A | * | 1/1972 | Kent | 273/157 R |
| 3,707,287 | A | * | 12/1972 | Spector | 273/157 R |
| 4,223,890 | A | * | 9/1980 | Schoen | 273/157 R |
| 4,358,115 | A | * | 11/1982 | Haas | 273/157 R |
| 4,522,404 | A | * | 6/1985 | Di Gregorio | 273/157 R |
| 4,561,097 | A | * | 12/1985 | Siegel | 273/157 R |
| 4,723,382 | A | * | 2/1988 | Lalvani | 273/157 R |
| 4,773,649 | A | * | 9/1988 | Cheng | 273/157 R |
| 4,830,376 | A | * | 5/1989 | Hillis | 273/157 R |
| 4,844,466 | A | * | 7/1989 | Johnson et al. | 273/157 R |
| 4,913,436 | A | * | 4/1990 | Li | 273/157 R |
| 5,314,183 | A | * | 5/1994 | Schoen | 273/157 R |
| 5,605,332 | A | | 2/1997 | Harnett | |
| 5,762,336 | A | | 6/1998 | Miller | |

(Continued)

*Primary Examiner* — Steven Wong

(57) ABSTRACT

A puzzle game includes a first and a second group of several pieces each. Several assemblies of pieces may be selected of the two groups. Three pieces of the first group are different from each other by the piece shape. Each of the pieces of the second group of pieces are different in shape from each of the pieces of the first group. Each of the assemblies forms an object, which objects are externally the same. Each of the different assemblies includes at least one piece of the first group and at least one piece of the second group. The formed objects are two or three dimensional objects. Preferably, each of the formed objects consists of identical cells. For example, the first and second groups consist of respectively three and six pieces. Each of three assemblies includes one piece and two pieces of the respective first and second groups.

2 Claims, 14 Drawing Sheets

(56) References Cited

U.S. PATENT DOCUMENTS

| | | | | |
|---|---|---|---|---|
| 5,868,388 | A * | 2/1999 | Wood et al. | 273/157 R |
| 6,648,330 | B2 | 11/2003 | Porter | |
| 7,731,192 | B1 * | 6/2010 | Marhefka | 273/157 R |
| 8,387,989 | B2 * | 3/2013 | Baum | 273/157 R |
| 2004/0082256 | A1 * | 4/2004 | Ahn | 446/85 |
| 2005/0230910 | A1 * | 10/2005 | Urriza | 273/160 |
| 2008/0274665 | A1 | 11/2008 | Cheng | |
| 2009/0020947 | A1 * | 1/2009 | Albers | 273/157 R |

* cited by examiner

CUBE PUZZLE

CROSS-REFERENCE TO RELATED APPLICATIONS

The present application claims the priority benefits of U.S. provisional application No. 61/300,046 entitled "CUBE PUZZLE" by the present inventor, filed Feb. 1, 2010. The present application is a national phase application of PCT application PCT/IL2011/000062 entitled "CUBE PUZZLE" by the present inventor, filed Jan. 20, 2011.

THE FIELD OF INVENTION

The invention is in the field of indoor games and computerized games, and in particular in the field of puzzles, including three-dimensional combination puzzles or jigsaw games.

THE PRIOR ART

A puzzle game of the prior art is illustrated in FIG. 1. A two-dimensional object is divided to five pieces. Someone disassembles the object and a player tries to assemble it. The game designer determines the number of pieces in accordance with a desired challenge: up to ten pieces for infants and small kids, tens of pieces for children and hundreds of pieces for youth or adults.

Usually, a picture is imprinted on the object, and the player utilizes the piece outline, its content, color and texture to overcome the assembly challenge. As mentioned, the game complexity is determined, to much extent, by the number of pieces. Also, the similarity of various pieces affects the challenge. To overcome the puzzle challenge, the player uses determination, patience, imagination and systematic thinking.

The competitive field of games continuously calls for novel ideas and greater variety. This is especially important in the field of puzzles, which should nowadays overcome the fierce competition from a variety of computer games and virtual reality games. Thus, it is an objective of the present invention to add a new dimension of complexity and interest to traditional puzzle games. Another objective of the present invention is to introduce puzzle games into the realm of computer technology and virtual reality. Further objective of the present invention is to introduce puzzle games to mathematical education field, as well as to field of occupational psychology. The embodiments given bellow on the way of example may contribute to the achievement of those objectives.

BRIEF DESCRIPTION OF THE INVENTION

It is disclosed, for the first time, a method for designing and constructing a puzzle game. The method comprises the steps of choosing a designed object, dividing the designed object to four or more different designed parts, splitting the four or more designed parts to at least two sets, a first set of one or more parts and a second set of three or more different parts, and designing and producing a group of three or more pieces.

The four or more different designed parts are different by at least the part shape. Each part of the first set is adjacent prior to the dividing to at least two parts of the second set. Each piece of the group of three or more pieces includes a first part and a second part. The first part is selected of the parts of the first set, and the second part is selected of the at least two parts of the second set that have been adjacent prior to the dividing to the first part.

In some embodiments the method further comprises producing three or more different parts of the second set of three or more different parts.

In some embodiments, the method is performed using at least one computer code, and the method further comprises integrating the parts and pieces into a computerized game enabling manipulation of the parts and pieces and allowing assembly of the designed object.

It is provided for the first time, a puzzle game that comprises a first group of three or more pieces, a second group of three or more pieces, and three or more different assemblies of pieces selected of a united group of pieces. At least three pieces of the first group of three or more pieces are different from each other by at least the piece shape. Each of the pieces of the second group of three and more pieces are different in shape from each of the pieces of the first group of three or more different pieces. The united group of pieces consists of the pieces of the first group and the pieces of the second group. Each of the three or more assemblies forms an object, and the three or more formed objects are substantially the same object regarding external boundary. Each of the three or more different assemblies includes at least one piece of the first group and at least one piece of the second group.

In some embodiments, the formed objects are two-dimensional objects.

In some embodiments, the formed objects are three-dimensional objects.

In some embodiments, each of the formed objects consists of a plurality of identical cells.

In some embodiments the first group consists of three different pieces, and the second group consists of six pieces, and each of the three or more assemblies includes one piece of the first group and two pieces of the second group.

In some embodiments, every two pieces of the united group of pieces which are shapely different from each other are also painted differently.

In some embodiments, the puzzle game is a computerized game.

It is disclosed for the first time a method for providing a puzzle game, the method comprises the steps of providing a first group of three or more pieces, providing a second group of three or more pieces, and allowing to manipulate the pieces of a united group of pieces and to assemble three or more different assemblies of pieces of the united group of pieces. At least three of the three or more pieces of the first group are different from each other by at least the piece shape. Each of the pieces of the second group is different in shape from each of the pieces of the first group. The united group of pieces consists of the first group and the second group. Each of the three or more different assemblies forms an object, and the three or more formed objects are substantially the same object regarding external boundary. Each of the three or more different assemblies includes at least one piece of the first group and at least one piece of the second group.

In some embodiments, the game is a computerized game, and the pieces and the formed objects are virtual articles that a player is able to sense.

It is provided, for the first time, a method for a server providing a puzzle game to a client computing device. The method comprises providing the client computing device a first group of three or more pieces, providing the client computing device a second group of three or more pieces, and allowing manipulation of the pieces of a united group of pieces and assembly of three or more different assemblies of pieces selected of that united group of pieces.

At least three of the pieces of the first group are different from each other by at least the piece shape. Each of the pieces of the second group is different in shape from each of the pieces of the first group. The united group of pieces consists of the first group and the second group. Each of the three or more assemblies forms an object. The three or more formed objects are substantially the same object regarding external boundary. Each of the three or more different assemblies includes at least one piece of the first group and at least one piece of the second group.

In some embodiments, the method further comprises interacting with the client computing device during manipulation of the pieces of the united group and during assembly of the three or more different assemblies.

It is provided a method for a puzzle game in a client computing device. The client computing device is associated with a server, and the method comprises receiving a first group of three or more different pieces, receiving a second group of three or more pieces, manipulating the pieces of a united group of pieces, and assembling three or more different assemblies of pieces of the united group of pieces.

In some embodiments, the method further comprises interacting with the server during the manipulation of the pieces of the united group and during assembly of the three or more different assemblies.

In some embodiments, the client computing device is selected from a group consisting of personal computers, cellular phones, portable media players and personal digital assistants.

In some embodiments, the formed object is selected from a group consisting of cubes, spheres, cylinders, boxes, bars, pyramids, squares, rectangle, triangles, trapezoids and a disks.

In some embodiments, the server and the client computing are connected through the world wide web network.

Further features and advantages of the present invention will be apparent from the description bellow of several preferred embodiments.

BRIEF DESCRIPTION OF THE DRAWINGS

The invention is herein described, by way of example only, with reference to the accompanying drawings, which illustrate several preferred embodiments of the invention.

DESCRIPTION OF PREFERRED EMBODIMENTS

Figure 1:
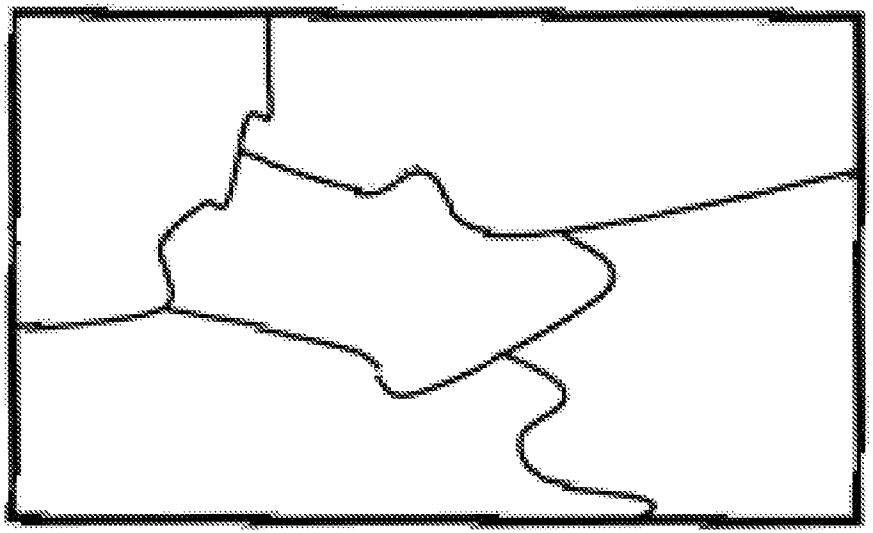
Fig. 1 Prior art
FIG. 1 (Prior Art) presents a puzzle game of the prior art.

The present invention will now be described in terms of specific example embodiments. It is to be understood that the invention is not limited to the example embodiments disclosed. It should also be understood that not every feature of the methods and systems handling the described puzzle game is necessary to implement the invention as claimed in any particular one of the appended claims. Various elements and features of devices are described to fully enable the invention. It should also be understood that throughout this disclosure, where a method is shown or described, the steps of the method may be performed in any order or simultaneously, unless it is clear from the context that one step depends on another being performed first.

Before explaining at least three embodiments of the invention in detail, it is to be understood that the invention is not limited in its application to the details of construction and the arrangement of the components set forth in the following description or illustrated in the drawings. The invention is capable of other embodiments or of being practiced or carried out in various ways. Also, it is to be understood that the phraseology and terminology employed herein is for the purpose of description and should not be regarded as limiting.

Unless otherwise defined, all technical and scientific terms used herein have the same meaning as commonly understood by one of ordinary skill in the art to which this invention belongs. The materials, methods, and examples provided herein are illustrative only and not intended to be limiting.

In the description and claims of the present application, each of the verbs "comprise", "include" and "have", and conjugates thereof, are used to indicate that the object or objects of the verb are not necessarily a complete listing of members, components, elements or parts of the subject or subjects of the verb.

Manipulation of two articles includes bringing the articles closer, rotating either one of the articles, attaching the two articles to one another, and any combination thereof.

Assembly of several articles includes selection of the several articles out of a group of more articles and bringing them close to each other.

A First Preferred Embodiment

FIGS. 2,3

Figure 2:
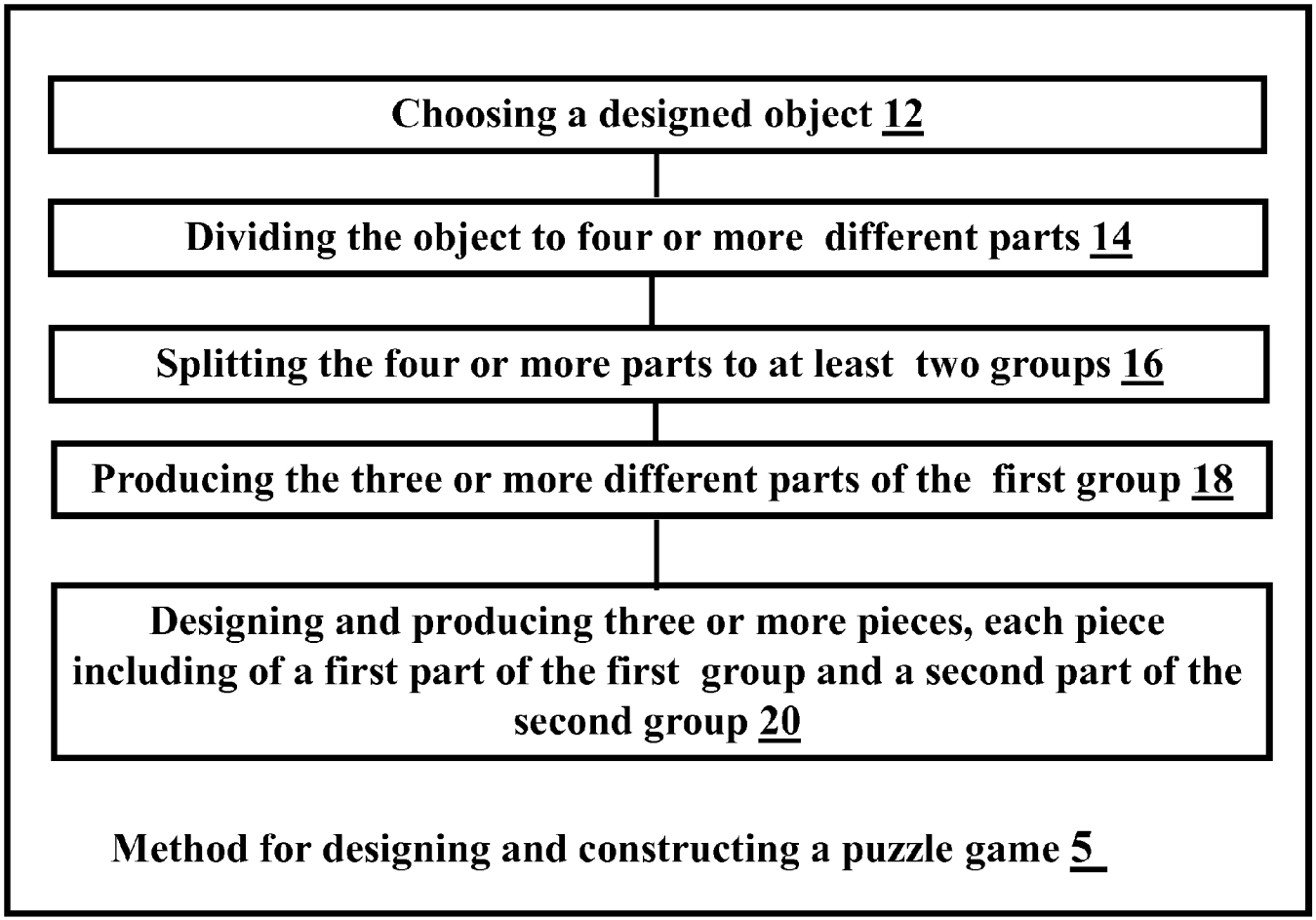
FIG. 2 is a flowchart of a method for designing and constructing a puzzle game.

FIG. 2 is a flowchart of a method 5 for designing and constructing a puzzle game. Method 5 comprises the steps of choosing 12 a designed object, dividing 14 the designed object to four or more different designed parts, splitting 16 the four or more designed parts to at least two sets, a first set of one or more parts and a second set of three or more different parts, producing 18 the three or more different parts of that second set, and designing and producing 20 a group of three or more pieces.

In some embodiments, method 5 is performed using at least one computer code. The method further comprises integrating the parts and pieces into a computerized game that enables manipulation of the parts and pieces and assembly of the designed object. In one example, the parts and pieces are designed using a computer aided design code, AUTOCAD for example, and the integration is performed in a game engine. In another example, all the steps of the method are performed in a game engine and a player gets a stand alone computerized game to play with. In other example, the computerized game may be played by a client computing device connected on line to a server.

Figure 3A:
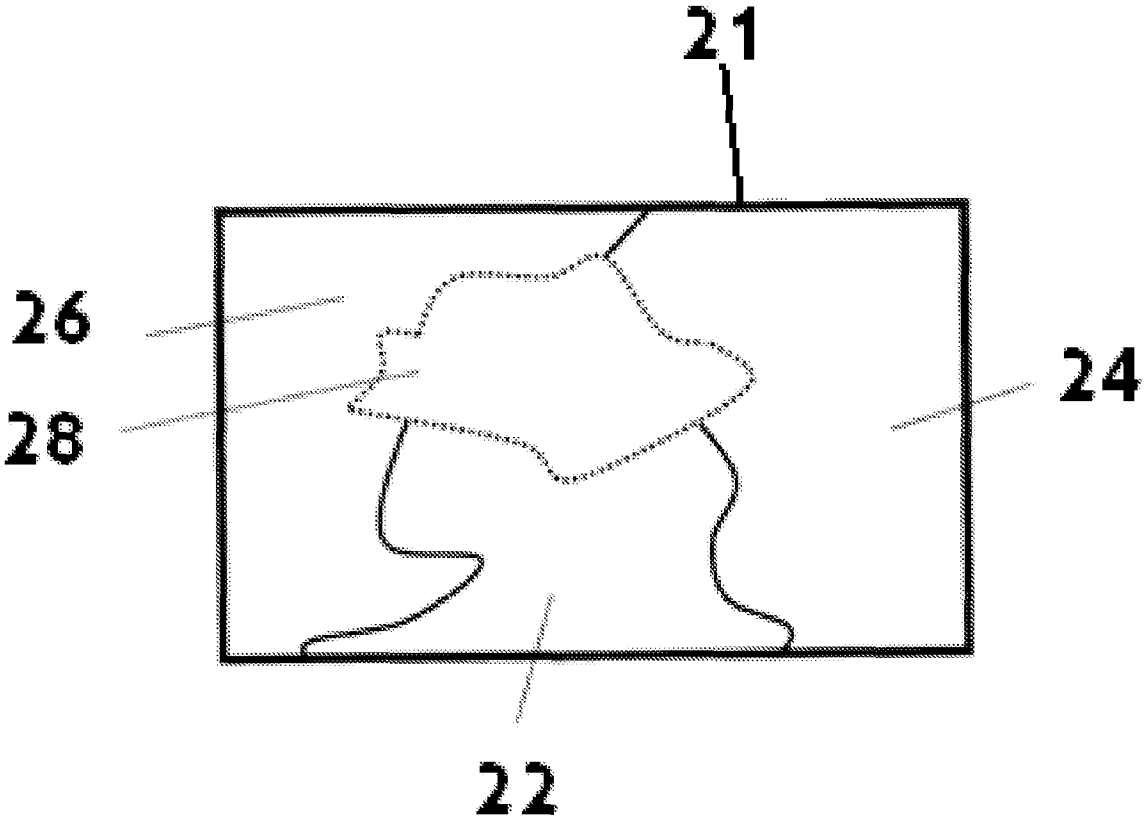
FIG. 3*a* shows the division of a rectangle into four parts.

An exemplary designed rectangular object 21 is shown in FIG. 3*a*. The four different designed parts 22, 24, 26 and 28 are different by shape. The first set of one or more parts includes part 28, which is adjacent prior to the dividing 14 to parts 22, 24 and 26 of the second set of three parts. The group of pieces includes pieces 22&28, 24&28 and 26&28, shown in FIGS. 3*b*,3*c* and 3*d*, respectively. Piece 22&28 includes part 28 and part 22, piece 24&28 includes part 28 and part 24, and piece 26&28 includes part 28 and part 26.

A puzzle game of the first embodiment includes a first group of three different pieces 22&28, 24&28 and 26&28, and a second group of three pieces, 22,24,26, which together form a united group of six pieces. In one preferred embodiment the six pieces of the united group are presented to a player together, without any clue regarding the division to a first group and a second group. The game rules call the player to select three pieces of the united group of pieces and assemble three different assemblies that form a rectangle. Three different assemblies are exemplified in FIGS. 3*b*, 3*c* and 3*d*. Each of the assemblies forms an object, and the three formed objects are the same rectangular object 21 regarding external boundary. Each of the three different assemblies includes one piece of the first group and two pieces of the second group. Every piece of the united group is used at one or more of the three assemblies.

The player may find the three successful assemblies by trial and error. However, by trial and error the player may repeat certain unsuccessful assembly combinations for several times each, which is quite frustrating. Being more efficient, the player may use systematic thinking and analysis talent to invoke two concepts which facilitate successful assemblies.

The first concept is to use high school level combinatory theory and find that the number of different combinations (or assemblies) of three pieces out of six pieces is 20. Consequently, the player may enlist the 20 combinations, and try every possible combination exactly one time. Thus, playing the game may be used as an educational exercise or manifestation of combinatory theory.

The second concept is to get insight into the structure of the six pieces, and thus discover the design concept of a common part shared by three pieces. In the embodiment of FIG. 3, the player should reveal that part 28 is common to 22&28, 24&28 and 26&28, and understand that every combination should include one and only one piece out of 22&28, 24&28 and 26&28. Based on that insight, the player realizes that to get a successful combination, he should select a first piece out of 22&28, 24&28 and 26&28, and then select two pieces out of 22,24,26 which two pieces complement the first piece to a square.

Figure 3B:
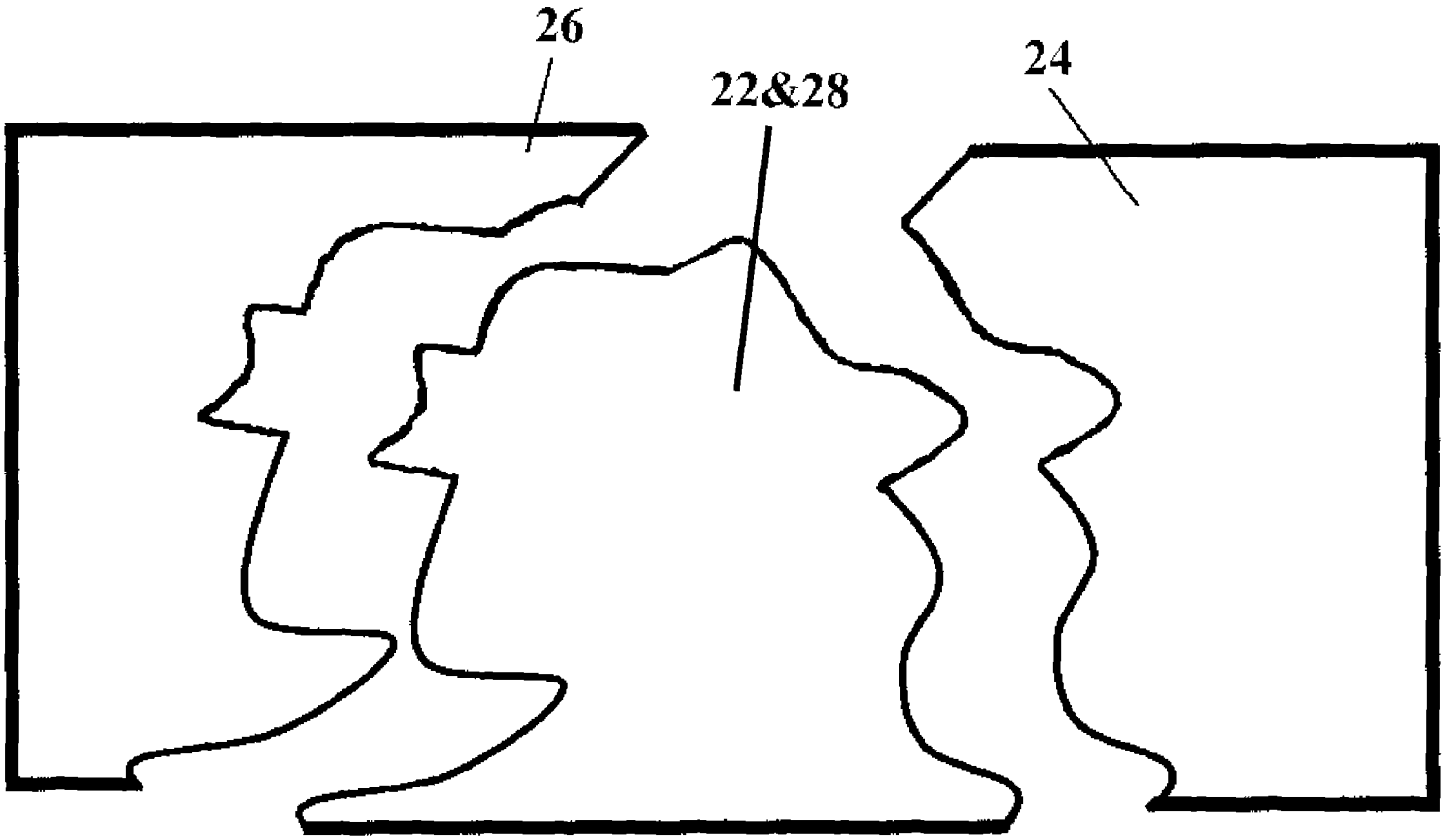
FIG. 3*b* depicts a first assembly of three pieces forming a rectangle.
Figure 3C:
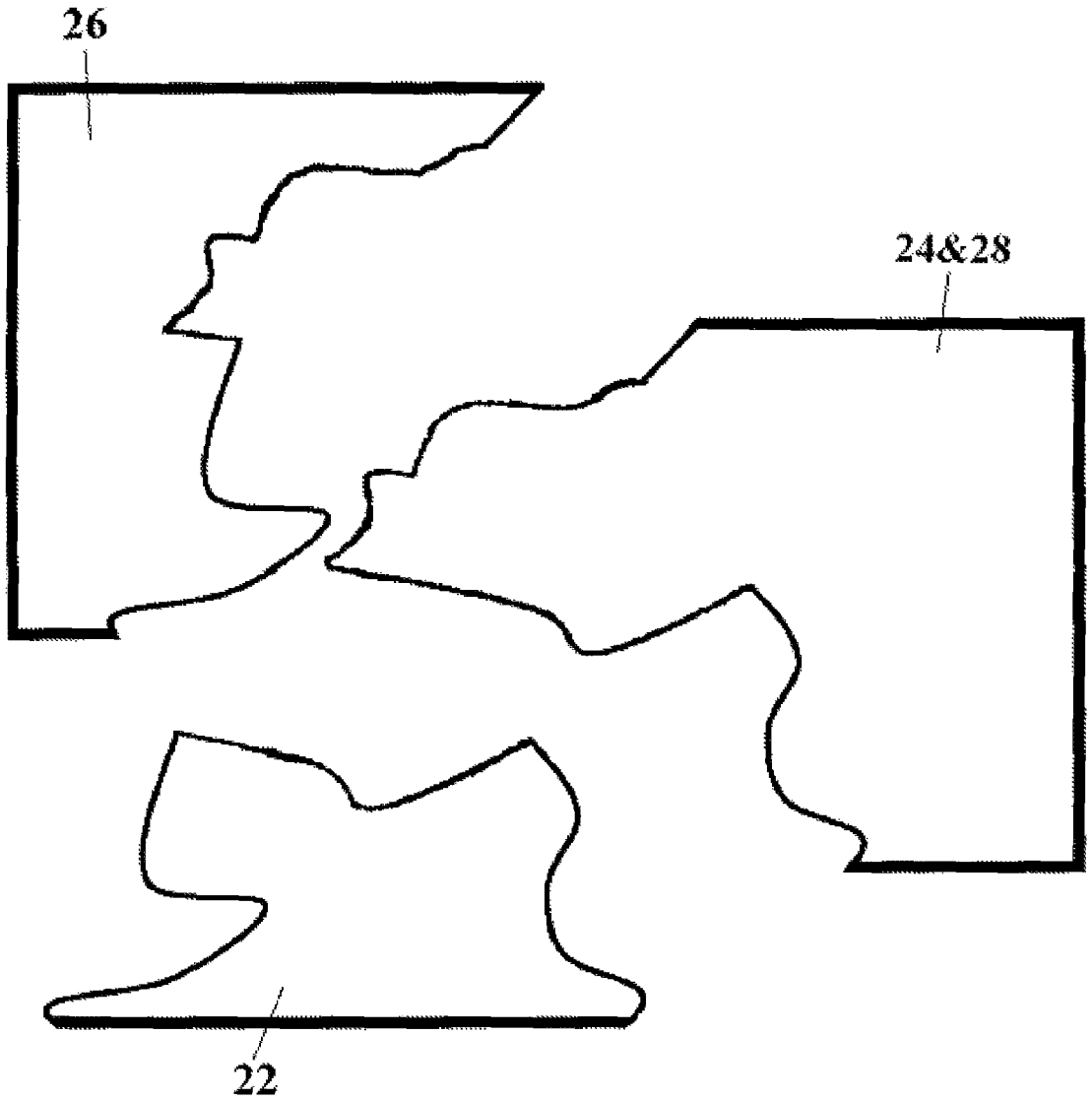
FIG. 3*c* depicts a second assembly of three pieces forming a rectangle.
Figure 3D:
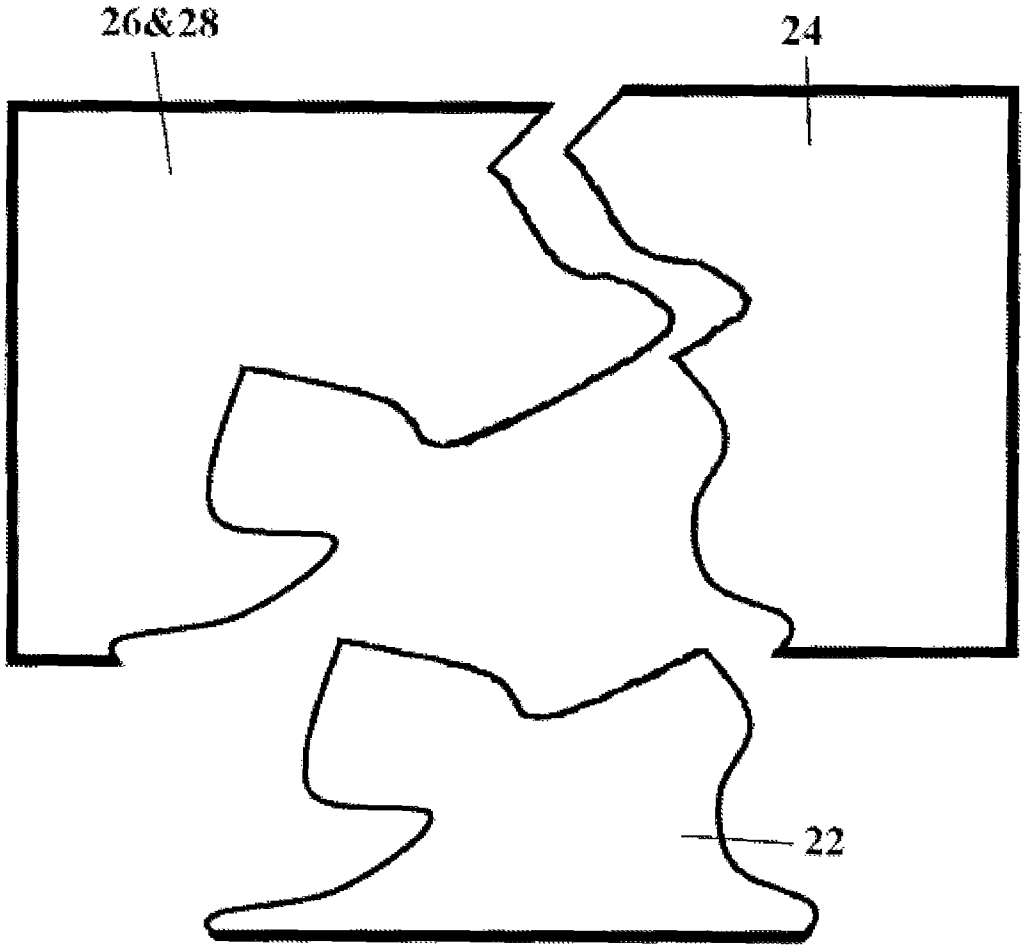
FIG. 3*d* depicts a third assembly of three pieces forming a rectangle.

In another version of the embodiment of FIG. 3, a player gets three copies of frame 21: a first frame with 24, 26 and 22&28 as shown in FIG. 3*b*, a second frame with 26, 22 24&28 as shown in FIG. 3*c*, and a third frame with 22, 24 and 26&28 as shown in FIG. 3*d*. Someone disassembles the pieces out of the three frames, and the player has to reassemble them and get three complete rectangular frames.

The pieces might be painted uniformly, painted differently for different pieces or painted differently for each piece.

In some embodiments, the pieces of the united group are made of cardboard. In one embodiment, the pieces are made of a magnetic material and a compatible magnetic board is included in the game.

A Second Preferred Embodiment

FIG. 4

A second preferred embodiment of method 5 is described in FIG. 4, wherein the chosen 12 object is square 30 consisting of 16 identical cells. The square is divided 14 to five parts 32, 34,36,37 and 38. The five parts are split 16 to two sets, a first set of two parts 37 and 38, and a second set of three different parts 32,34 and 36. Part 37 is adjacent to parts 34 and 36 in object 30 prior to the dividing 14. Similarly, part 38 is adjacent to parts 32, 34 and 36 in object 30 prior to the dividing 14.

Figure 4B:
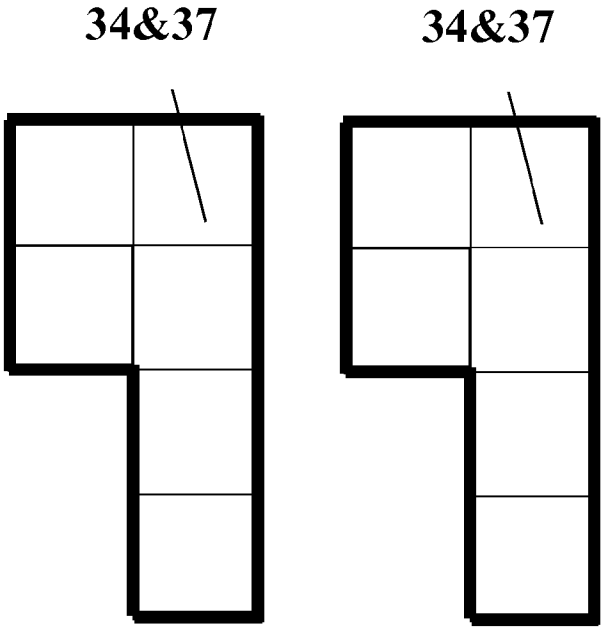
FIG. 4*b* shows two identical pieces, each made of two parts.
Figure 4A:
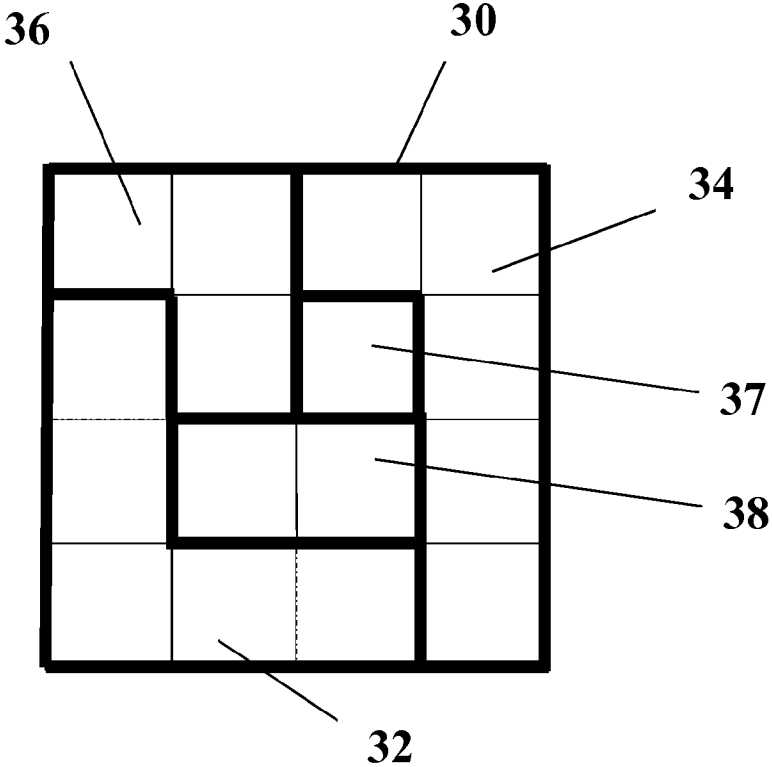
FIG. 4*a* shows a square divided into five parts.
Figure 4D:
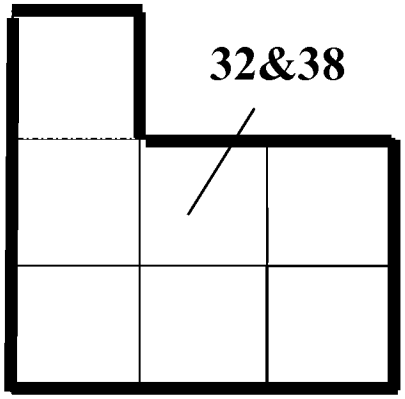
FIG. 4*d* shows two identical pieces, each piece made of two parts.
Figure 4D:
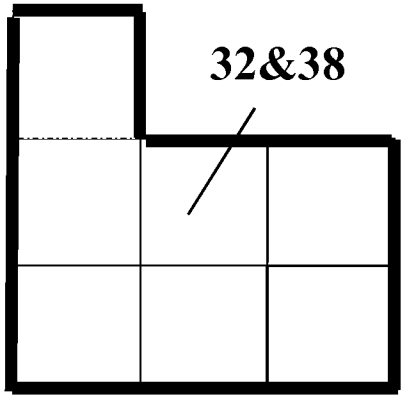
Figure 4C:
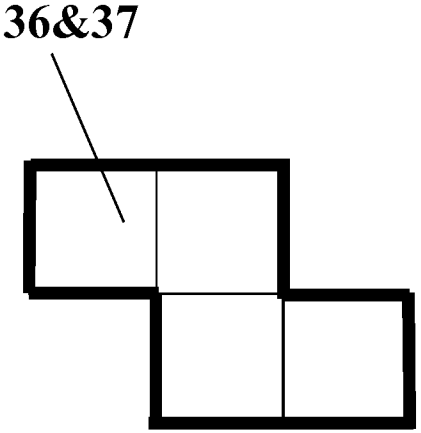
FIG. 4*c* shows a piece made of two parts.
Figure 4E:
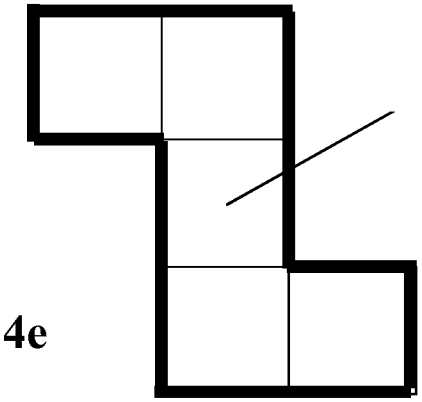
FIG. 4*e* shows a piece made of two parts.

Piece 34&37 of FIG. 4*b* is designed and produced 20 as a combination of part 34 and part 37. Similarly, pieces 36&37, 32&38, and 36&38 of FIGS. 4*c*,4*d*, and 4*e*, respectively, are designed and produced 20 by a combination of a part of the first set with a part of the second set. One more copy of each of the pieces 34&37 and 32&38 is also produced.

In some embodiments of the puzzle game, the puzzle game includes a first group of three different pieces 32,34 and 36, and a second group of six pieces which include pieces 36&37, 36&38, two pieces 34&37, and two pieces 32&38. The following three assemblies may form the designed square object:

a. Pieces 34&37, 32&38, 36.
b. Pieces 36&38, 34&37, 32.
c. Pieces 36&37,32&38, 34.

In some embodiments the game is provided as the three assembled squares formed by the assemblies a, b and c. The player or someone else disassembles the squares into pieces and the player tries to assemble the pieces into the original squares.

In some embodiments the game is provided as eight pieces 32, 34, 36, 36&37, 36&38,34&37,32&38 and a piece made of part 34 and part 38. The game have rules which call the player to assemble as many as possible different assemblies of three pieces out of the eight pieces and form a square. There are 56 assemblies of three different pieces of eight different pieces, and only four assemblies form a square object. The identical cells of the square may relief the challenge as the user may count the number of identical cells in a tried assembly and reject the assembly immediately if the number is not 25.

A Third Preferred Embodiment

FIG. 5

Figure 5A:
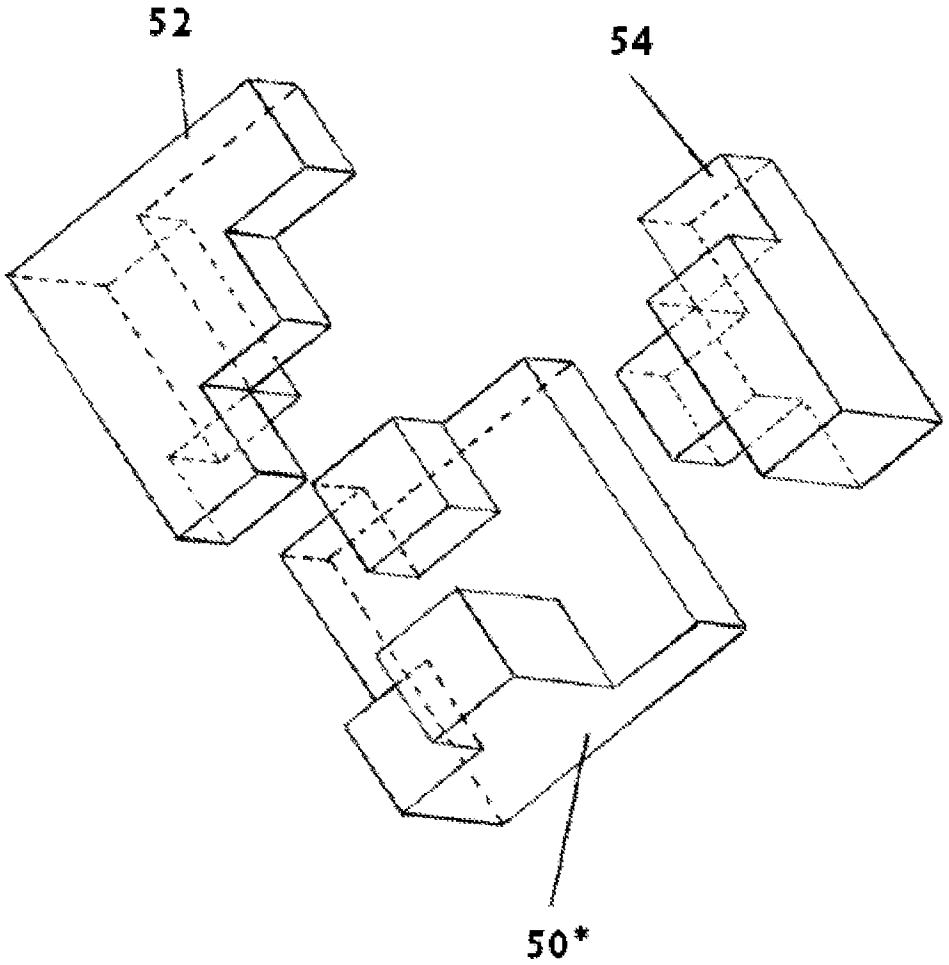
FIG. 5*a* shows a first assembly of three pieces that form a cube.
Figure 5B:
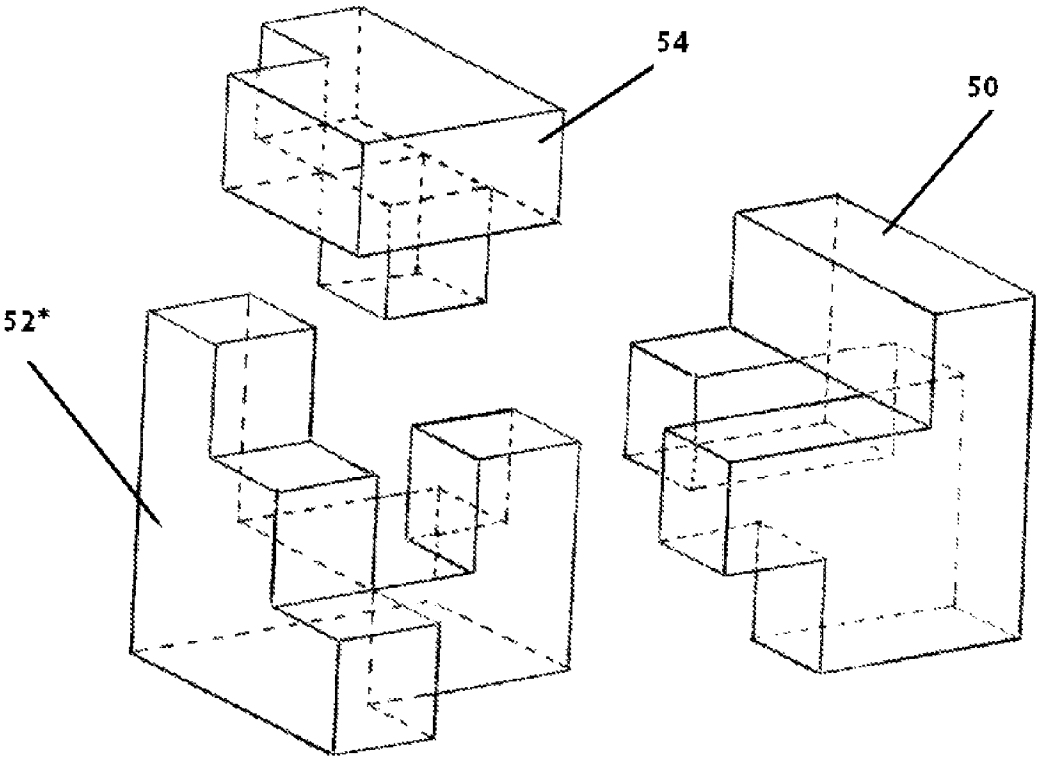
FIG. 5*b* shows a second assembly of three pieces that form a cube.
Figure 5C:
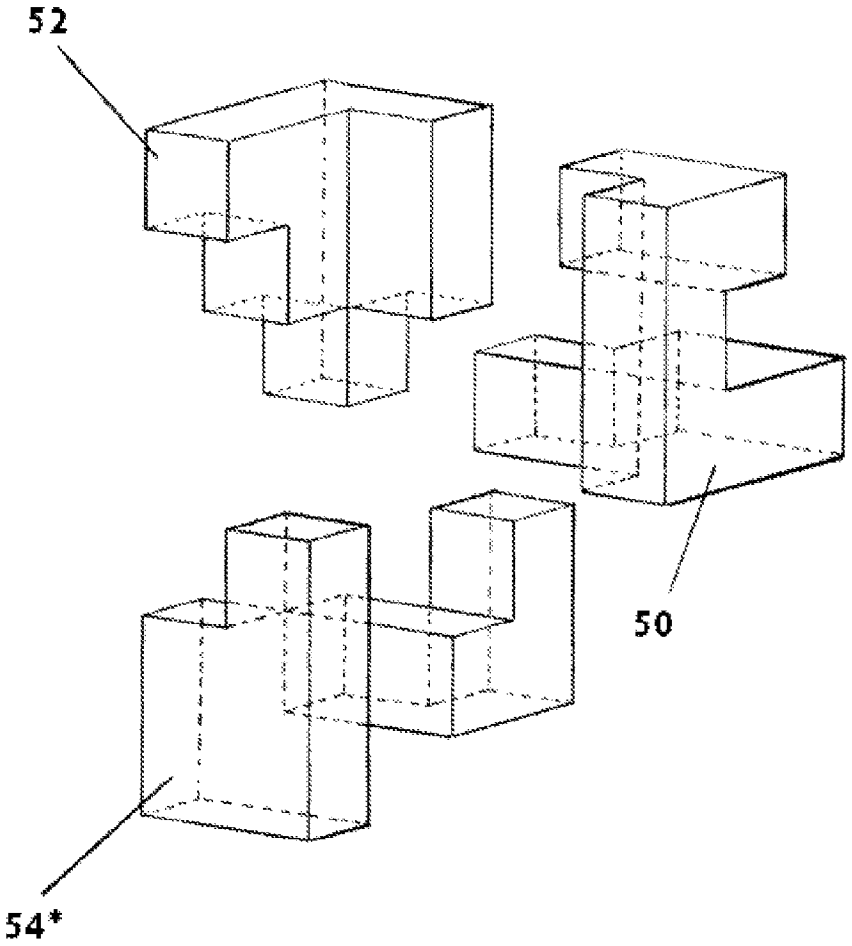
FIG. 5*c* shows a third assembly of three pieces that form a cube.

A three-dimensional embodiment of the present invention is illustrated in FIG. 5, wherein the object is a 3×3×3 cube composed of 27 identical cells. In one embodiment, a player gets a first group of three different pieces 50*, 52* and 54*, and a second group of six pieces, two pieces of each of 50, 52 and 54. FIGS. 5*a*, 5*b* and 5*c* show three combinations (assemblies) that could be assembled to form the cube: pieces 50*, 52 and 54 in FIG. 5*a*, pieces 50, 52* and 54 in FIG. 5*b*, and pieces 50, 52 and 54* in FIG. 5*c*. To find those combinations, the player may write down all the possible combinations, count the identical cells, reject the combinations which do not sum up to 27 cells, and finally tries the combinations which sum up to 27 cells.

The player might also notice that each of the pieces 50*, 52* and 54*, is the respective piece 50, 52 and 54, with a L shaped part made of three cubic cells. As the L part should appear in every successful combination, the player might deduce that the successful combinations are those of FIGS. 4*a*, 4*b* and 4*c*.

In other words, the game of FIGS. 5*a-c* consists a first group of three pieces 50*,52* and 54* and a second group of six pieces, overall nine pieces. Each of the three pieces of the first group is different from each other by at least the piece shape. The game also includes a second group of six pieces, two shapely identical pieces 50, two shapely identical pieces 52 and two shapely identical pieces 54. Each of the pieces of the second group of six pieces is different in shape from each of the pieces of the first group of three pieces 50*, 52* and 54*. Each of the three pieces 50*, 52* and 54* consists a first part and a certain L shaped part. The first part is identical in shape to one of the six pieces of the second group. For example, the first part of piece 50* is identical to piece 50 of the second group. The L shaped part is the same part for all of the three pieces 50*, 52* and 54* of the first group.

Each of the six pieces of the second group is associated with a respective piece of the first group: the two pieces 50 are associated with piece 50*, the two pieces 52 are associated with piece 52*, and the two pieces 54 are associated with piece 54*. As shown in FIGS. 5*a-c*, three different assemblies of pieces are possible and coexist simultaneously, whereas each assembly consists one piece of the first group and two pieces of the second group. Each of the three assemblies is able to form a cube. The three formed cubes are the same cube regarding external boundary. The nine pieces of the first and second group allow for simultaneous coexistence of the three formed cubes.

In some embodiments of the cube puzzle, the game is provided as three or more assembled cubes, of which three assemblies are different from each other. Once disassembled, a player should assemble the three or more cubes, as shown in FIG. 4. Note that each piece is assembled in at least one assembly forming a cube.

In some embodiments, extra pieces that can not be assembled in any assembly that forms a cube are also given to increase the challenge.

In some embodiments, only one set of pieces 50, 52 and 54 is provided and only one assembly is possible at a time. In this case, the game should include rules to guide the player towards the addressed challenge.

In some embodiments, a two-party game is provided, including ten assembled cubes, for example. Initially, the ten cubes are disassembled to pieces and placed in a common pot. A player throws a die to decide on the first player to pick a piece, and then each player takes a piece in turn, assembles them to a cube, and lays the assembled cube one over another to get a tower. The winner is the player with a taller tower.

In some embodiments, the pieces are made of wood. For example, the pieces may be manufactured by gluing identical wooden cubes sold as raw material in hobby stores.

In some embodiments, the pieces may be made of moldable material, polymers and metal, for example.

A Fourth Preferred Embodiment

FIG. 6

Figure 6:
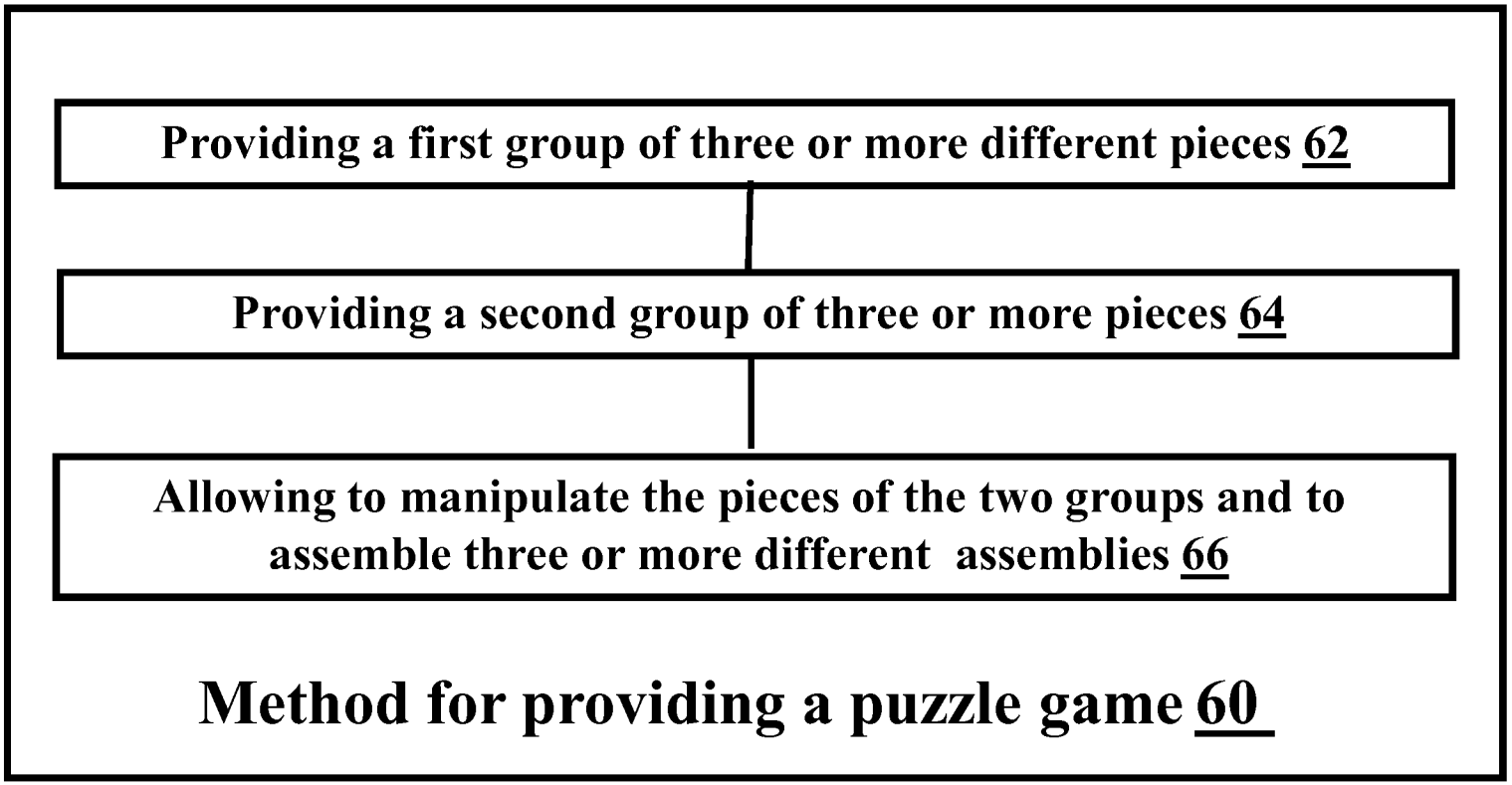
FIG. 6 is a flowchart of a method for providing a puzzle game.

FIG. 6 illustrates a method 60 for providing a puzzle game. Method 60 includes a step 62 of providing a first group of three or more pieces, a step 64 of providing a second group of three or more pieces, and a step 66 of allowing to manipulate the pieces of a united group of pieces and to assemble three or more different assemblies of pieces of the united group of pieces. At least three of the three or more pieces of the first group are different from each other by at least the piece shape. Each of the pieces of the second group of three and more pieces are different in shape from each of the pieces of the first group of three or more different pieces. The united group of pieces consists of the first group and the second group. Each of the assemblies forms an object, and the three or more formed objects are substantially the same object regarding external boundary. Each of the three or more different assemblies includes at least one piece of the first group and at least one piece of the second group.

In some embodiments, the game is a computerized game, and the pieces and the formed objects are virtual articles that a player is able to sense. In one embodiment, the pieces are drawn on a screen and the player may displace each of them to pieces together, rotate each piece through several axes of rotation, and thus bring pieces together and integrate them into a cube. Those manipulation may be done with a mouse, or by touching the screen in a touch screen, smart phone, etc. In other embodiment, virtual reality techniques may enable 'feeling' the touch of the pieces.

Server-Client Embodiment

FIG. 7,8

Figure 7:
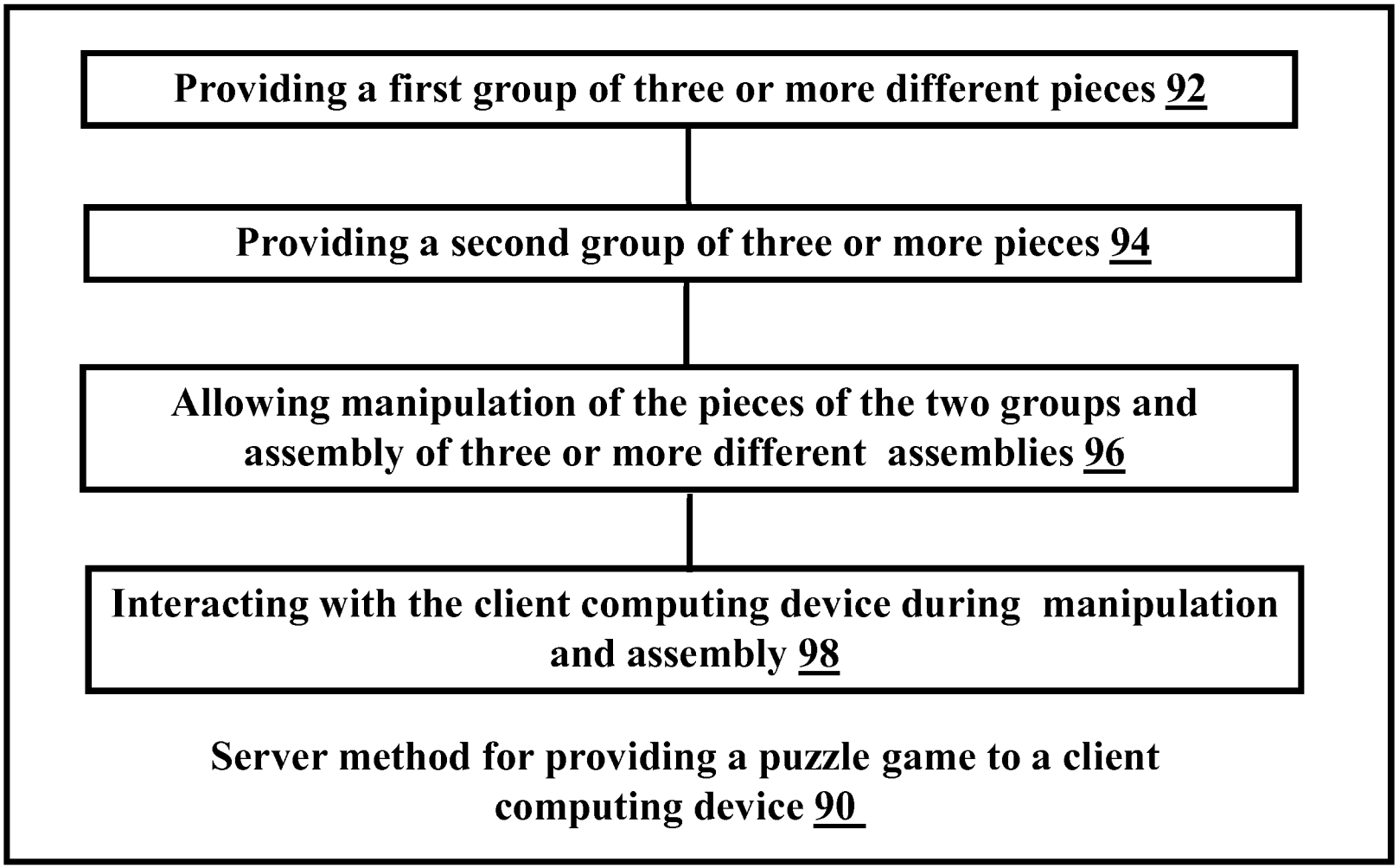
FIG. 7 is a flowchart of a server method for providing a puzzle game to a client computing device.

FIG. 7 is a flowchart of a method 90 for a server providing a puzzle game to a client computing device. Method 90 comprises providing 92 the client computing device a first group of three or more pieces, providing 94 a second group of three or more pieces, and allowing 96 manipulation of the pieces of a united group of pieces and assembly of three or more different assemblies of pieces selected of that united group of pieces.

At least three of the pieces of the first group are different from each other by at least the piece shape. Each of the pieces of the second group is different in shape from each of the pieces of the first group. The united group of pieces consists of the first group and the second group. Each of the assemblies forms an object. The three or more formed objects are substantially the same object regarding external boundary. Each of the three or more different assemblies includes at least one piece of the first group and at least one piece of the second group. The puzzle cube game of FIG. 5 is an example of a game that a server may provide to a client computing device.

In some embodiments, each piece is assembled in at least one of the formed objects, which formed objects are substantially the same object regarding external boundary.

In some embodiments, the method further includes interacting 98 with the client computing device during manipulation of the pieces of the united group and during assembly of the three or more different assemblies. For example only, the server may indicate by some tone or by a jumping banner that an assembly which may form the object have been assembled, and may indicate by another tone or another jumping banner that a desired object have been actually formed. Also, as time elapses without progress, the server may suggest a clue to make the challenge easier. Providing a clue may be initiated by a player request as well.

Figure 8:
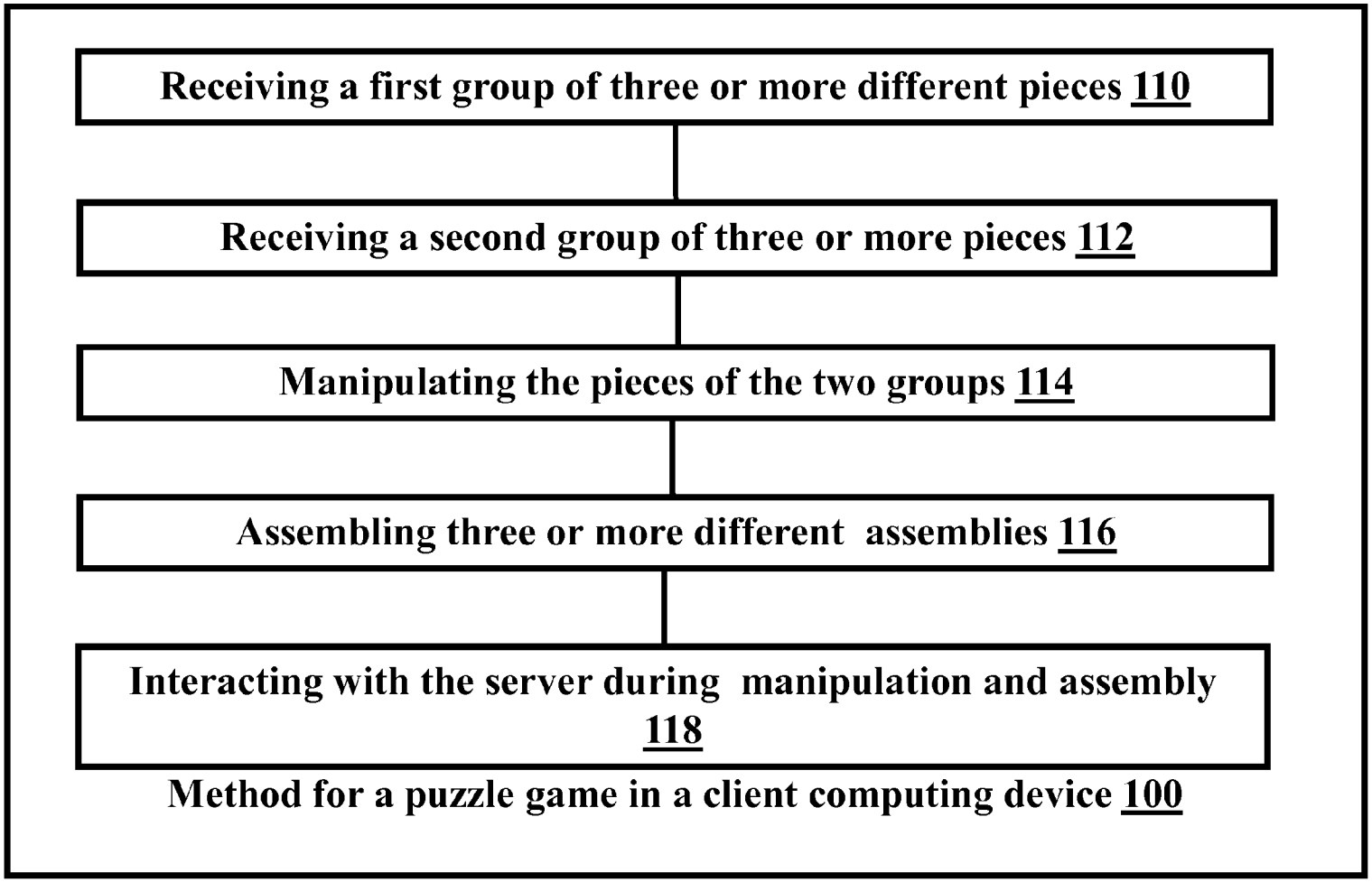
FIG. 8 is a flowchart of a method for a puzzle game in a client computing device.

FIG. 8 is a flowchart of a method 100 for a puzzle game in a client computing device. The client computing device is associated with a server, and the method 100 includes receiving 110 a first group of three or more different pieces, receiving 112 a second group of three or more pieces, manipulating

114 the pieces of a united group of pieces, and assembling 116 three or more different assemblies of pieces of the united group of pieces.

In some embodiments, the method further includes interacting 118 with the server during the manipulation of the pieces of the united group and during assembly of the three or more different assemblies.

In some embodiments, the client computing device is selected from a group consisting of personal computers, cellular phones, portable media players and personal digital assistants.

In some embodiments, the formed object is selected from a group consisting of cubes, spheres, cylinders, boxes, bars, pyramids, squares, rectangle, triangles, trapezoids and disks.

In some embodiments, the server and the client computing are connected through the world wide web network.

Having thus described the foregoing exemplary embodiments it will be apparent to those skilled in the art that various equivalents, alterations, modifications, and improvements thereof are possible without departing from the scope and spirit of the claims as hereafter recited. In particular, different embodiments may include combinations of features other than those described herein. Accordingly, the claims are not limited to the foregoing discussion. Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The invention claimed is:

1. A puzzle game consisting nine game pieces, the puzzle game comprising:

a) a first group of three pieces, each of the three pieces of the first group being different from each other by at least the piece shape;

b) a second group of six pieces, said six pieces consisting three piece pairs, the two pieces of each piece pair being identically shaped, each of the pieces of the second group of six pieces being different in shape from each of the pieces of said first group of three pieces;

c) each of said three pieces of said first group consisting a first part and a certain part, said first part being identical in shape to each of an associated piece of a pair of identically shaped pieces of said six pieces of said second group, said certain part being the same part for all of said three pieces of said first group;

d) each of said six pieces of said second group being associated with a respective piece of said first group by being identical in shape to its first part;

e) said first group of three pieces and said second group of six pieces enabling three simultaneously coexisting different assemblies of three pieces, each assembly consisting one piece of said first group and two pieces of said second group; and f) each of said three assemblies enabling forming a cube, the three formed cubes being the same cube regarding external boundary.

2. The puzzle game of claim 1, wherein every two differently shaped pieces of said nine pieces are painted differently.

* * * * *